US009897283B2

(12) United States Patent
Schwaiger et al.

(10) Patent No.: US 9,897,283 B2
(45) Date of Patent: Feb. 20, 2018

(54) GENERATING A LIGHT EMISSION PATTERN BY ILLUMINATING A PHOSPHOR SURFACE

(71) Applicant: OSRAM GmbH, Munich (DE)

(72) Inventors: Stephan Schwaiger, Ulm (DE); Oliver Hering, Niederstotzingen (DE); Juergen Hager, Herbrechtingen (DE)

(73) Assignee: OSRAM GMBH, Munich (DE)

( * ) Notice: Subject to any disclaimer, the term of this patent is extended or adjusted under 35 U.S.C. 154(b) by 425 days.

(21) Appl. No.: 14/552,588

(22) Filed: Nov. 25, 2014

(65) Prior Publication Data

US 2015/0176805 A1 Jun. 25, 2015

(30) Foreign Application Priority Data

Dec. 19, 2013 (DE) ..... 10 2013 226 650

(51) Int. Cl.

| | |
|---|---|
| ***F21V 11/00*** | (2015.01) |
| ***F21V 9/08*** | (2018.01) |
| ***F21S 8/10*** | (2006.01) |
| ***F21V 13/08*** | (2006.01) |
| ***F21V 9/16*** | (2006.01) |
| *F21Y 101/00* | (2016.01) |

(52) U.S. Cl.

CPC ..... *F21V 9/08* (2013.01); *F21S 48/1145* (2013.01); *F21S 48/1225* (2013.01); *F21S 48/1757* (2013.01); *F21V 9/16* (2013.01); *F21V 13/08* (2013.01); *F21Y 2101/00* (2013.01)

(58) Field of Classification Search

CPC .... F21V 9/16; F21V 9/08; F21V 13/08; F21S 48/115; F21S 48/1145; F21S 48/1225

See application file for complete search history.

(56) References Cited

U.S. PATENT DOCUMENTS

| | | | | |
|---|---|---|---|---|
| 6,798,575 | B2 | 9/2004 | Kobayashi | |
| 2005/0110954 | A1 | 5/2005 | Kojima | |
| 2006/0044297 | A1 | 3/2006 | Furukawa et al. | |
| 2011/0249460 | A1 | 10/2011 | Kushimoto | |
| 2013/0265561 | A1* | 10/2013 | Takahira | F21V 7/06 356/3 |

(Continued)

FOREIGN PATENT DOCUMENTS

| | | | |
|---|---|---|---|
| DE | 102007025330 | A1 | 12/2008 |
| DE | 102009025678 | A1 | 1/2010 |

(Continued)

OTHER PUBLICATIONS

German Search Report issued in DE102013226650.2 dated Oct. 2, 2014.

(Continued)

*Primary Examiner* — Evan Dzierzynski

(74) *Attorney, Agent, or Firm* — Viering, Jentschura & Partner mbB

(57) ABSTRACT

A method for generating a light emission pattern by illuminating at least one phosphor surface by at least one primary light beam is provided. The method includes: directing the primary light beam only onto a partial surface of the entire illuminatable phosphor surface; and illuminating at least one partial region of said partial surface more intensely than in the case of uniform illumination of the illuminatable phosphor surface.

17 Claims, 6 Drawing Sheets

(56) References Cited

U.S. PATENT DOCUMENTS

| | | | | |
|---|---|---|---|---|
| 2014/0029282 | A1* | 1/2014 | Ravier | F21S 48/17 362/510 |
| 2015/0016135 | A1* | 1/2015 | Erdl | F21S 48/1159 362/510 |

FOREIGN PATENT DOCUMENTS

| | | | |
|---|---|---|---|
| DE | 102012205437 | A1 | 10/2013 |
| EP | 1351522 | A2 | 10/2013 |
| JP | 2010006109 | A | 1/2010 |
| WO | 2013149766 | A1 | 10/2013 |

OTHER PUBLICATIONS

Chinese Office Action based on application No. 201410795880.6 (7 pages and 7 pages of English translation) dated Mar. 28, 2017 (Reference Purpose Only).

* cited by examiner

GENERATING A LIGHT EMISSION PATTERN BY ILLUMINATING A PHOSPHOR SURFACE

CROSS-REFERENCE TO RELATED APPLICATION

This application claims priority to German Patent Application Serial No. 10 2013 226 650.2, which was filed Dec. 19, 2013, and is incorporated herein by reference in its entirety.

TECHNICAL FIELD

Various embodiments relate generally to a method for generating a light emission pattern by illuminating a phosphor surface within a predetermined image set-up time by at least one primary light beam. Various embodiments also relate to a lighting device for generating a light emission pattern within a predetermined image set-up time, including at least one light source for generating at least one primary light beam, and a deflection unit for directing the primary light beam generated by the at least one light source onto a phosphor surface, wherein the phosphor surface is designed, at a focal spot of a primary light beam, at least partly to convert the associated primary light into secondary light having a different wavelength. Various embodiments are applicable, for example, to headlights, e.g. of motor vehicles, in particular with AFS ("Adaptive Frontlighting System") or ADB ("Adaptive Driving Beam").

BACKGROUND

For generating temporally varying light emission patterns, there is the possibility of writing corresponding light distributions by means of a laser to a conversion colorant spaced apart therefrom ("Remote Phosphor"). The light distribution ("illumination pattern") arising there can be imaged by traditional imaging systems into a far field and there can generate the desired light emission pattern. In this case, in general an illumination pattern set up in a matrix-like fashion is written to a screen and directed during an image set-up or within a predetermined image set-up time by a deflection unit for directing a primary light beam generated by the at least one light source successively onto each pixel. If a pixel is intended to be illuminated, the light source is switched on. If no pixel is intended to be illuminated, the light source is switched off. Alternatively, the light source may also be driven in continuous operation and be used for optional illumination and non-illumination of a diaphragm. For illumination purposes in the case of this method what is disadvantageous is that if only a portion of the possible pixels is illuminated, the total light power emitted thereby also decreases within the predetermined image set-up time.

DE 10 2007 025 330 A1 discloses a projection device including at least two light sources for emitting respective light beams and a projection unit for deflecting the light beams onto a projection surface, wherein at least two of the light sources are aligned such that they emit the light beams at a predefined angle with respect to one another. A further projection device includes at least two light sources for collinearly emitting respective light beams, a deflection system for non-collinearly deflecting the light beams, and a projection unit for deflecting the non-collinear light beams onto a projection surface, wherein the deflection system includes at least one common micro-optical element.

EP 1 351 522 A2 discloses a scanning optical display system which has a small number of parts and is easily miniaturized. The system includes a multiplicity of light sources which emit light having mutually different wavelength ranges, a light combining element for combining the multiplicity of light beams emitted by the light sources, and an optical scanning system which applies the combined light to a scan surface in a scanning fashion. The light combining element is an optical diffraction element.

US 2005/0110954 A1 discloses a light projector including a projection means for projecting an image onto a screen for image representation by the scanning of laser light. The laser light contains a multiplicity of laser beams. The projection unit irradiates a substantially identical position on the screen with the multiplicity of laser beams with a time difference. An image signal assigned at each of the laser beams has a time difference, such that a preceding laser beam is delayed in relation to a succeeding laser beam in order to correspond to the time shift in the irradiation.

US 2006/0044297 A1 discloses an image display device including a light source having a multiplicity of light emitters and an optical projection system, whereby light from the light source is radiated in a scanning fashion in a main scan direction and in a subsidiary scan direction in order to generate an image having a predefined number of pixels on a screen. The scan lines in the main scan direction are formed by the light emitted by each of the light emitters and are controlled in such a way that they are imaged on the screen in a manner superimposed on one another.

In order to generate light emission patterns having temporally varying light distributions ("Adaptive Frontlighting System"; AFS), especially without large moving parts, matrix LED headlights or an HID-AFS (HID=High Intensity Discharge Lamp) with rotating shutter rollers are known. A negative factor here is that in each pixel of the light emission pattern the amount of light kept available or even generated needlessly must suffice to ensure that the maximum possible, desired brightness can always be achieved. In total, therefore, too much potential light power is kept available, which is typically not utilized during operation in practice.

SUMMARY

A method for generating a light emission pattern by illuminating at least one phosphor surface by at least one primary light beam is provided. The method includes: directing the primary light beam only onto a partial surface of the entire illuminatable phosphor surface; and illuminating at least one partial region of said partial surface more intensely than in the case of uniform illumination of the illuminatable phosphor surface.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
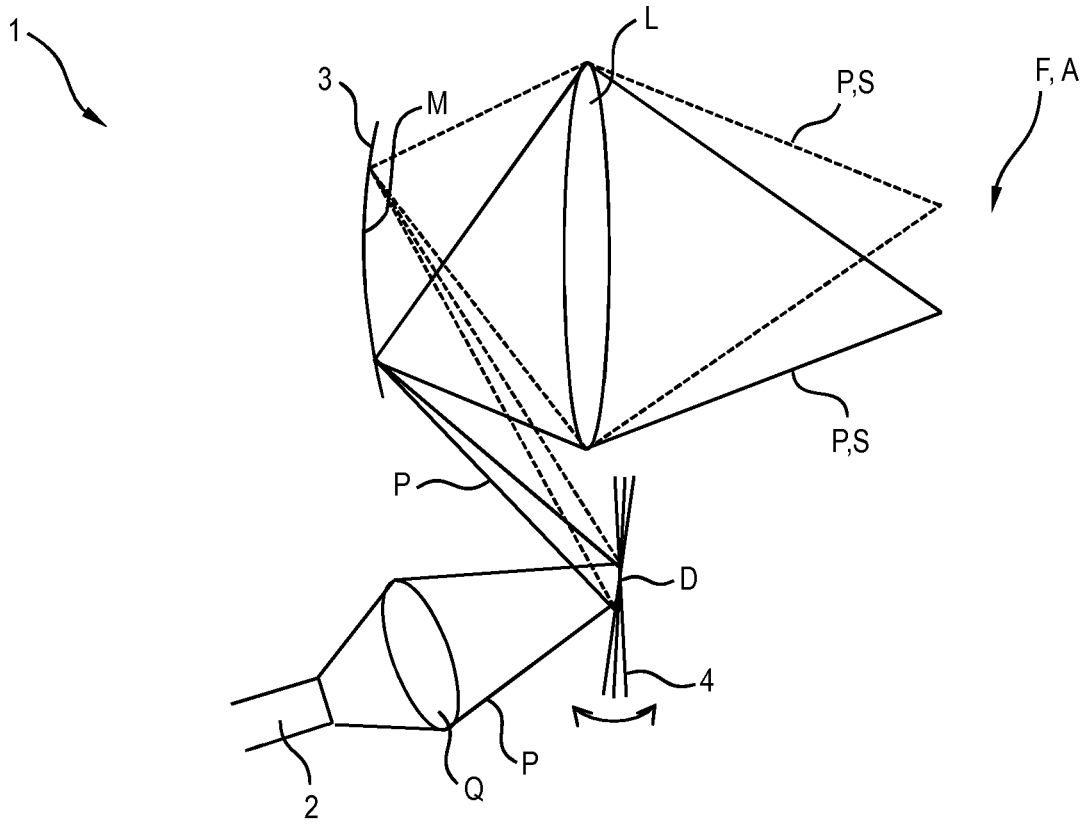
FIG. 1 shows a possible construction of a lighting device as a sectional illustration in side view.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments may at least partly overcome the disadvantages of the prior art and, for example, provide a particularly efficient and inexpensive possibility for generating a light emission pattern for light projection.

Various embodiments provide a method for generating a light emission pattern by illuminating a phosphor surface by means of at least one concentrated primary light beam, wherein the primary light beam is directed only onto a partial surface ("targeted partial surface") of the illuminatable phosphor surface, and at least one partial region of said partial surface is illuminated more intensely than in the case of uniform illumination of the illuminatable phosphor surface. The illumination may take place within a predetermined image set-up time.

The comparison with the uniform illumination of the illuminatable phosphor surface may be related to uniform illumination with maximum total light power. The comparison with the uniform illumination of the illuminatable phosphor surface may be related to uniform illumination of the phosphor surface that is maximally illuminatable within the predetermined image set-up time, e.g. of the entire phosphor surface.

This method may afford the effect that that time proportion of the image set-up time which hitherto has been allocated without use when aligning a light beam with a non-illuminated region of the phosphor surface can now at least partly be used to illuminate for longer and thus more intensely within the image set-up time the partial surface which in principle is targeted and thus illuminatable by a primary light beam. Consequently, said partial surface can shine at least regionally or partly more brightly. Provision of a higher-intensity laser can be dispensed with as a result. Moreover, various embodiments may be implemented by an easily implementable adaptation of existing lighting devices. The total light power in the case of the illumination of the targeted partial surface is, by way of example, not higher than the total light power in the case of the uniform illumination of the—e.g. entire—illuminatable phosphor surface. The total light powers may be identical, for example.

The illumination pattern may bring about, for example, an identical or at least similar light emission pattern in a far field. The illumination pattern may be subjected to further beam shaping by a downstream optical unit. The downstream optical unit may include e.g. at least one lens, at least one diaphragm, at least one collimator, etc.

A phosphor surface may be understood to mean, for example, a surface of an object which is covered with at least one phosphor, e.g. in a layered fashion. The phosphor surface therefore has at least one phosphor or conversion colorant which converts the primary light of the primary light beam incident thereon at least partly into secondary light having a different wavelength, in particular having a longer wavelength. This wavelength conversion is known in principle, and need not be explained any further here. By way of example, a phosphor may partly convert incident blue primary light into yellow secondary light, such that overall blue-yellow or white mixed light having corresponding proportions of primary light and secondary light is radiated by the phosphor surface.

The phosphor surface may be at least partly planar and/or at least partly curved. The phosphor surface may have in particular different curvature progressions in different directions and can, for example, also assume any arbitrary freeform shape.

An image set-up time is understood to mean, in particular, that time duration which is required to set up an individual image of an image sequence reproduced at a specific image refresh frequency or image refresh rate.

For automotive applications, for example, it may be provided for the image set-up time to be 5 milliseconds or less. This corresponds to an image refresh rate of 200 Hz or more. This enables illumination which appears to be continuously variable or is non jerky even in the far field far in front of the vehicle. This in turn brings about an improved perception even of objects far away, and hence increased driving safety.

An image set-up time may e.g. also be understood to mean the time duration which is required in order to uniformly illuminate the phosphor surface, e.g. the entire phosphor surface. In the case of pixel-like illumination, this may correspond e.g. to the time duration which is required to illuminate all pixels successively for the same length of time, e.g. line by line in the case of a matrix-shaped arrangement of the pixels.

The targeted partial surface can be illuminated for just as long, considered in absolute terms, as the entire phosphor surface that is illuminatable within the image set-up time. As a result, a region of the targeted partial surface (e.g. a pixel) can be illuminated on average for longer than on the entire illuminatable phosphor surface. The smaller the targeted partial surface, the longer the set average illumination duration of an illuminated region thereof can be. The average illumination duration of the partial surface may be, for example, inversely proportional to an area proportion of the entire illuminatable phosphor surface that is constituted by the partial surface. By way of example, if a size of the targeted partial surface corresponds to only one third of the entire illuminatable phosphor surface, a region on the partial surface may be illuminated for a maximum of three times longer on average given an identical absolute image set-up time. The targeted partial surface may be illuminated over the whole area or only partly.

An illumination time of different illuminated regions of the targeted partial surface may be different. In various embodiments, specific regions, e.g. pixels, may be illuminated or generated by a primary light beam for longer or more frequently than other regions, and may be correspondingly more brightly luminous. A region of the targeted partial surface may also be illuminated for a shorter time than the standard illumination duration.

In one configuration, the phosphor surface is illuminatable in a pixel-like fashion and a portion of the pixels is illuminated for longer than in the case of the uniform illumination of the entire phosphor surface, in particular integrally within an image set-up time. The associated pixel-like illumination pattern enables a particularly simple, pixel-like set-up and a particularly simple and diverse variation of the form of the light emission pattern. A pixel may be generated in particular by a focal spot of a primary light beam on the phosphor surface. Adjacent focal spots may be spaced apart from one another or partly overlap. In the case of continuous movement of the primary light beam (e.g. in the case of a scanning system), different focal spots present at a specific point in time are generally no longer discernible or no longer resolvable by a human observer.

In another configuration, switching between two or more different illumination patterns of the phosphor surface is effected, e.g. with a similar total light power, e.g. with an identical total light power. As a result, a plurality of light emission patterns optimized e.g. toward a specific purpose can be generated with a high total light power rapidly, diversely and without additional apparatus outlay. In this regard, the light emission pattern can also be altered in the case of a transition between two images. By way of example, in the case of a vehicle headlight, switching between low beam, high beam, daytime running light and/or cornering light, if appropriate with or without additional spot illumination, can be effected. In various embodiments, each of the light emission patterns may have a total light power coordinated therewith, e.g. a maximum total light power. However, relatively large differences in the total light powers of different illumination patterns can also occur.

In one development, a total light power for illuminating the targeted partial surface corresponds to a proportion of at least 90% of a maximally achievable total light power for the uniform illumination of the entire illuminatable phosphor surface, e.g. of 95%, e.g. of 98%, e.g. of 100%. In this regard, a particularly bright light emission pattern can be provided. In various embodiments, such a targeted partial surface of an illumination pattern may be supplemented by an additional surface (e.g. by a "subsidiary surface" for generating a light spot in the far field, if appropriate at a distance from the original targetable partial surface), without the brightness of the original partial surface having to be changed. In other words, the provision of a "light power reserve" may enable simple switching-on of an additionally illuminated partial surface with maximally said light power reserve. The light power reserve may be in particular not more than 10%, e.g. not more than 5%, e.g. not more than 2%, of the maximally achievable total light power.

In a further configuration, the actually illuminated portion of the targeted partial surface (e.g. the entire partial surface) is illuminated more intensely at least partly by the light beam remaining for longer than in the case of the uniform illumination of the entire illuminatable phosphor surface. This may afford the effect that the illuminated portion is illuminatable on particularly short paths and thus with short dead times. This configuration may be advantageous, for example, if a deflection unit for directing the primary light beam generated by the at least one light source onto a phosphor surface is a deflection unit which deflects individually, that is to say for example does not move the primary light beam over the phosphor surface at a fixed speed. In the course of clocked operation of the primary light beam, the instance of the light beam remaining for longer may include e.g. remaining for more than one clock phase or switch-on phase.

In yet another configuration, the more intensely illuminated portion of the targeted partial surface is illuminated more intensely by means of multiple illuminations within the predetermined image set-up time. This configuration may be advantageous, for example, if a deflection unit for directing the primary light beam generated by the at least one light source onto a phosphor surface drives the primary light beam over the phosphor surface at a fixed speed. This configuration may be particularly easily implementable, e.g. in the case of a deflection unit which deflects in a scanning fashion, e.g. also with rotating mirrors or MEMS (Micro-Electro-Mechanical Systems) mirrors.

In one configuration, furthermore, the method serves for generating at least one light emission pattern of a vehicle, e.g. in the form of a low beam, a high beam, a fog light, a daytime running light and/or a cornering light.

In one configuration, moreover, at least one region from an illuminated partial surface is no longer illuminated on account of an object recognition. In this regard, by way of example, it is possible to prevent persons (pedestrians, cyclists, drivers of other vehicles) and wild animals from being dazzled.

In one development, furthermore, a method serves for generating a light emission pattern in a far field by illuminating at least one phosphor surface by at least one primary light beam, wherein the light emission pattern has an inhomogeneous color distribution. At the phosphor surface, the light is at least partly converted into secondary light having a different wavelength with the aid of at least one phosphor distributed in the phosphor surface. The inhomogeneous color distribution may have, for example, a purposefully spatially varied concentration of at least one color proportion of the mixed light in the far field. This development has the advantage that the light emission pattern varied in terms of color in the surface enables improved user-friendliness on account of color variation adapted to a specific function.

Various embodiments provide a lighting device for generating a light emission pattern, which lighting device is designed for carrying out the method described above. Said lighting device affords the same advantages as the method and can be embodied analogously.

In one configuration thereof, the lighting device is provided e.g. for generating a light emission pattern in particular within a predetermined image set-up time and includes at least one light source for generating at least one primary light beam, and a deflection unit for directing the primary light beam generated by the at least one light source onto a phosphor surface, wherein the phosphor surface is designed, at a focal spot of a primary light beam, at least partly to convert the associated primary light into secondary light having a different wavelength, wherein the lighting device is designed to direct the primary light beam only onto a targeted partial surface of the entire illuminatable phosphor surface, and an illumination duration of at least one focal spot in the targeted partial surface within the image set-up time is greater than a standard illumination duration for the uniform illumination of the (which is illuminatable in particular within a predetermined image set-up time) phosphor surface.

In various embodiments, the at least one light source includes at least one semiconductor light source. By way of example, the at least one semiconductor light source may include at least one diode laser. However, the laser may also be a general laser, which therefore need not be semiconductor-based. If a laser is used, this may also be referred to as an LARP ("Laser Activated Remote Phosphor") arrangement. However, the light source may e.g. also include at least one semiconductor light source in the form of at least one light emitting diode.

The deflection unit serves, in particular, to direct the at least one primary light beam onto different regions of the phosphor surface. The primary light beam is therefore concentrated in the sense that it does not illuminate the entire phosphor surface at one point in time.

The deflection unit may include, for example, at least one movable mirror. A movable mirror may be e.g. a rotatable mirror or a rotating mirror. Optionally, the deflection unit may also include at least one transmitted-light optical unit, e.g. a lens, a diaphragm, a collimator, a beam combiner, etc.

A standard illumination duration can be understood to mean that time duration with which a pixel is illuminated or generated in the case of uniform illumination of the entire illuminatable phosphor surface, e.g. with maximum total light power.

In another configuration, the deflection unit is a deflection unit which deflects in a scanning fashion in at least one spatial direction. This enables a particularly simple configuration. A deflection unit which deflects in a scanning fashion in a spatial direction may be understood to mean, for example, a deflection unit which aligns a primary light beam recurrently along said direction. The phosphor surface may be illuminated e.g. in a line-like fashion in said spatial direction.

In various embodiments, the deflection unit may direct the primary light beam continuously for a section having a specific length along the spatial direction and then swivel it back. The periodic deflection in said spatial direction may be achieved for example by a reflection of the primary light beam at a pivotable or rotatable mirror. In this case, a rotation axis of the mirror is, for example, perpendicular to the spatial direction. In various embodiments, the primary light beam may be aligned obliquely with respect to the spatial direction and the rotation axis of the mirror may be perpendicular to a plane spanned by the spatial direction and the primary light beam. The rotatable mirror may be for example a circumferentially rotating mirror or a mirror oscillating back and forth. The mirror may be a mirror driven e.g. by electric motor. In one configuration which may be provided for an accurate and possibly freely selectable positioning of the mirror, the mirror is an MEMS ("Micro Electro Mechanical System") mirror. The MEMS mirror, for example, also enables accurate step-by-step or stepwise pivoting.

In one development, a specific length of the section along the spatial direction is fixed, e.g. occupies a full width or height of the phosphor surface. In this variant, therefore, the deflection unit will always be aligned over the specific length, when the primary light beam need not illuminate the phosphor surface over the entire length. In this case, therefore, there may e.g. also be a portion or partial region of the targeted partial surface with which the deflection unit is aligned, but which is not illuminated. This development enables a particularly simple construction of the deflection unit.

In one development, moreover, a specific length of the section along the spatial direction can be set in a variable fashion. In this variant, the deflection unit can adapt the specific length in order to reduce or even entirely prevent a dead time in the case of alignment of the deflection unit without illumination. In this variant, for example, the primary light beam may illuminate the entire targeted partial surface (e.g. all actually targeted pixels), if appropriate with a different illumination power. This reduces a dead time for targeting specific regions of the partial surface without illumination.

In one development thereof, the deflection unit is a deflection unit which deflects in a scanning fashion only in one (first) spatial direction. This may enable a line-like set-up or a line-like illumination of the targetable partial surface of the phosphor surface, e.g. in the case of a matrix-like arrangement of the pixels. In the other (second) spatial direction, the deflection unit may bring about a for example step-by-step or stepwise deflection of the primary light beam, namely e.g. only if the deflection unit has caused the primary light beam to pass through entirely along a predetermined section in the first spatial direction. In this regard, a line-like image set-up can be achieved in a particularly simple manner. In this case, the step-by-step deflection in the second spatial direction may be used e.g. for a line advance (change of the line). For implementing a step-by-step deflection of the primary light beam, use may be made of e.g. a roller-like mirror which is rotatable step-by-step about its longitudinal axis and has a prism-shaped outer contour; alternatively a mirror which is pivotable step-by-step at least in the second spatial direction, e.g. a plane mirror. Said mirror may be a different mirror than the mirror which is pivotable in the first spatial direction, alternatively the same mirror. Particularly the mirror which is pivotable step-by-step may be e.g. a mirror which is pivotable by an actuator system (e.g. by means of at least one piezoactuator), e.g. an MEMS mirror.

In one development, moreover, the deflection unit is a deflection unit which deflects in a scanning fashion in two spatial directions (e.g. in an x-direction and in a y-direction). This may enable a particularly simple alignment of the entire phosphor surface.

In a further configuration, the deflection unit is a deflection unit which deflects individually in both spatial directions. In the case of this configuration, the primary light beam need not be aligned in a scanning fashion along a specific spatial direction, but rather can advantageously be aligned freely in both spatial directions. This opens up the possibility, for example, of directing the primary beam onto each desired region of the illuminatable phosphor surface in principle for a time duration of arbitrary length. Pivoting-back of the deflection unit without illumination of the phosphor surface can be obviated. The mirror may be pivotable freely in two spatial directions, for example. Such a mirror, in particular, may be an MEMS mirror.

In yet another configuration, the at least one switched-on light source is operable in a clocked fashion, wherein in a clock phase the light source is optionally switched on or switched off or dimmed During a switch-on phase, e.g. an identical beam power is always generated. Alternatively or additionally, a controllable diaphragm may be arranged in a path of the light beam. Dispensing with an amplitude modulation of the beam power of the light source in this way may simplify a configuration of the light source or the driving thereof. Moreover, particularly fast switching may thus be achieved. The duration of the clock phase may be chosen, for example, such that it corresponds to an irradiation of a pixel of the phosphor surface with the standard illumination duration.

In one configuration, moreover, the lighting device is a projection device for directing the light emitted by the phosphor surface as a light emission pattern into a far field. For this purpose, the lighting device may include at least one optical unit, e.g. imaging optical unit, disposed downstream of the phosphor surface. The optical unit may include e.g. one or a plurality of lenses, diaphragms, etc. The optical unit may also serve as a combination optical unit for combining a plurality of light beams.

In one configuration, moreover, the lighting device is a vehicle lighting device for illuminating an exterior of a vehicle. The vehicle lighting device may be a headlight, for example. The type of vehicle is not restricted, in principle, and may be e.g. a watercraft, an aircraft or a land-bound vehicle. The vehicle may be e.g. a motor vehicle, for example a truck or an automobile. The headlight may be provided e.g. for providing a light emission pattern for providing a low beam, a high beam, a fog light, a daytime running light and/or a cornering light.

It may be provided for the headlight to be an AFS ("Adaptive Frontlighting System") or an ADB ("Automated Driving Beam") headlight. This denotes, for example, a headlight which can adapt (e.g. can widen and/or shift) a light emission pattern (e.g. a low beam) depending on the state of the vehicle (e.g. a speed, a rain activity, a lock during steering, etc).

In one development, furthermore, the lighting device includes a plurality of phosphor surfaces, the light emitted by the latter can be superimposed in the far field, and at least two of the phosphor surfaces have different phosphors. In this case, the phosphor surfaces may be covered uniformly with the respective at least one phosphor. A purposefully variable color variation of the light emission pattern in the far field can then be achieved e.g. by a locally non-uniform illumination of different regions, e.g. pixels, of the phosphor surface(s). This locally non-uniform illumination may be achieved e.g. by an illumination/non-illumination of specific regions e.g. in the manner of a digital illumination pattern. Moreover, an illumination power of different illuminated regions may be different (e.g. by means of a different radiation power [e.g. in the case of an amplitude-modulatable light source] and/or a different irradiation duration).

In another development, at least two of the phosphor surfaces are illuminatable by primary beams of identical color. This enables particularly simple and inexpensive provision of primary light beams. By way of example, two identical light sources, e.g. lasers, may be used. Alternatively or additionally, at least one beam splitter may be disposed downstream of a light source, e.g. laser.

In one development, moreover, at least two of the phosphor surfaces are illuminatable by primary beams of different colors. In this regard, a greater diversity of phosphors can be used, which enables particularly efficient light conversion and particularly simple generation of desired color proportions.

In another development, moreover, a color of at least one region of the light emission pattern is dynamically or time-dependently variable. In this regard, the light emission pattern can be adapted e.g. to changes in the surroundings, e.g. after recognition of a moving object.

In one development, furthermore, a color of at least one region of the light emission pattern is variable on account of an object recognition. In this regard, an improved recognition of the object can be achieved. By way of example, a recognized object may be illuminated in a warning color or illuminated in a framed fashion, e.g. with red or whitish-red color. For the case where the lighting device is a headlight, for example, this may increase a perception of the arriving vehicle in the case of an illuminated road user. Moreover, dazzle may thus be reduced, which is e.g. also advantageous for illuminating wild animals.

In one development, moreover, the lighting device includes at least one phosphor surface having an inhomogeneous surface distribution of at least one phosphor. This enables a particularly compact design with few component parts. By way of example, a concentration distribution of a phosphor may be over a large area and/or gradual.

Alternatively, at different regions, e.g. corresponding to pixels, of the phosphor surface there may be locally separated partial regions each having different phosphors, e.g. embodied as phosphor points. These partial regions may be individually illuminatable, e.g. by means of a correspondingly sharp or locally concentrated primary light beam.

In one development, moreover, the lighting device is designed to illuminate only a variable partial surface of the entire illuminatable phosphor surface, e.g. by one or a plurality of primary light beams. In this regard, light emission patterns having different color distributions can be generated in a simple manner by varying a form and/or position of the partial surface on the phosphor surface.

In one development, in addition, the lighting device is a vehicle lighting device for illuminating an exterior of a vehicle. The vehicle lighting device may be a headlight, for example. The type of vehicle is not restricted, in principle, and may be e.g. a watercraft, an aircraft or a land-bound vehicle. The vehicle may be e.g. a motor vehicle, for example a truck or an automobile. The headlight may be provided e.g. for providing a light emission pattern for providing a low beam, a high beam, a fog light, a daytime running light and/or a cornering light.

It may be provided for the headlight to be an AFS ("Adaptive Frontlighting System") headlight. This denotes, for example, a headlight which can adapt (e.g. widen and/or shift) a light emission pattern (e.g. a low beam) depending on the state of the vehicle (e.g. a speed, a rain activity, a lock during steering, etc.).

In another development, the lighting device is designed to generate predetermined light emission patterns (e.g. associated with a low beam, a high beam, a fog light, a daytime running light, a cornering light, a spotlight after an object recognition, etc.) with predetermined color distributions. By way of example, bluish-white light may yield a particularly good recognition of a roadway, yellowish-white light may have a less dazzling effect, reddish-white light may have a warning function, etc.).

In one development, in addition, the light emitted by at least one of the phosphor surfaces or the corresponding at least one remote phosphor lighting device is white or whitish mixed light. This facilitates generation of white or whitish light in the far field. A (cumulative) color locus of said mixed light may lie in particular within the ECE-R white field.

In one specific development thereof, the light emitted by at least two (especially by all) of the remote phosphor lighting devices is white or whitish mixed light.

FIG. 1 shows a possible construction of a lighting device 1 as a sectional illustration in side view. The lighting device 1 may constitute for example a part of a vehicle headlight.

The lighting device 1 includes a light source in the form of a laser 2, which generates a concentrated primary light beam P composed e.g. of blue light. The primary light beam P is directed via a primary optical unit Q and a deflection unit onto a phosphor surface 3, which is illustrated as curved purely by way of example here, and generates an illumination pattern M.

For this purpose, the deflection unit includes an MEMS mirror 4, which is pivotable at least about a rotation axis D (as indicated by the double-headed arrow). By the MEMS mirror 4, the primary light beam P can be aligned on the phosphor surface 3 at least along a line (in x-direction relative to the phosphor surface 3, as explained more precisely in FIG. 2). The MEMS mirror 4 is shown here in three rotational positions which it can assume by way of example, e.g. two end positions and a central position.

On account of its configuration as an MEMS element, the MEMS mirror 4 can be directed, for a time duration that is freely selectable in principle, onto an arbitrary position at least within this line and can generate a focal spot there. The MEMS mirror 4 may be pivotable step-by-step or in a stepwise manner. Alternatively, it may be pivotable continuously.

Figure 2:
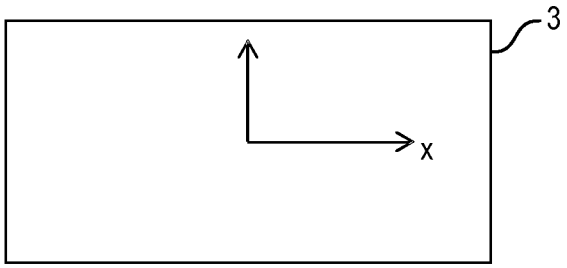
FIG. 2 shows in a frontal view a phosphor surface of the lighting device from FIG. 1.

For the case where the MEMS mirror 4 is pivotable back and forth only about a rotation axis D the deflection unit may have a further mirror (not illustrated), which is disposed e.g. between the MEMS mirror 4 and the phosphor surface 3 and can align e.g. the primary light beam P on the phosphor surface 3 along a column (in the y-direction relative to the phosphor surface 3, as explained more precisely in FIG. 2). Said further mirror may be e.g. one that is rotatable about a rotation axis perpendicular to the rotation axis D. The further mirror, too, may be an MEMS mirror, alternatively e.g. a roller-like mirror having a prism-like cross-sectional shape. Said further mirror can e.g. also be integrated into the first mirror, that is to say that a two-dimensionally rotatable mirror is involved in this case.

For the case where the MEMS mirror 4 is also pivotable about a rotation axis perpendicular to the rotation axis D, only this MEMS mirror 4 is required in order to freely align the primary light beam P on the phosphor surface 3. The MEMS mirror 4 can then be directed for a time duration that is freely selectable, in principle, onto an arbitrary position of the phosphor surface 3 and can generate a focal spot there. However, the MEMS mirror 4 pivotable about two rotation axes may also be operated in a scanning fashion at least in one direction.

The phosphor surface 3 is covered with a layer including at least one phosphor which converts the light of the primary light beam P partly into secondary light S having a higher wavelength, e.g. into yellow light. As a result, blue-yellow or white mixed light P, S is emitted by the phosphor surface 3. This mixed light P, S is imaged by means of a downstream optical unit, here indicated by a lens L, into a far field F in order to generate there a desired light emission pattern A, e.g. an adaptive low beam. This figure illustrates light beams assigned to two different rotational positions or rotational angles of the MEMS mirror 4, and specifically illustrates them with continuous and dotted lines, respectively.

The phosphor surface 3 may for example also have a proportion of at least one further phosphor which converts the blue primary light P wholly or partly into red secondary light in order to generate a warmer hue (e.g. "warm-white").

FIG. 2 shows the phosphor surface 3 in plan view. The phosphor surface 3 is illuminatable in a pixel-like fashion, for example by a pixel-like arrangement of separate phosphor points, by a corresponding direction of the primary light beam P and/or by means of the laser 2 being suitably switched on and off. With a midpoint at (x;y)=(0;0) the here square matrix has a range of (x;y) (−m;−n) to (m;n), which corresponds to a number of 2m*2n pixels. By way of example, the integer m=320, 512, 640 etc. The integer n may be e.g. 240, 320, 512 etc. In principle, m and n are not restricted, but e.g. assume at least the value 16. Preference is given to a number of pixels of at least 512, e.g. of at least 800, e.g. of more than 100 000, e.g. of 3 200 000 or more.

Figure 3:
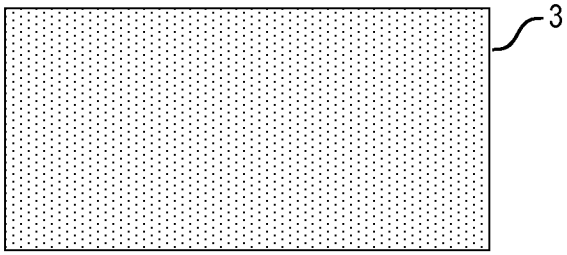
FIG. 3 shows in a frontal view the phosphor surface from FIG. 2 in a completely uniformly illuminated state.

FIG. 3 shows a phosphor surface 3 wherein all possible pixels are illuminated uniformly, i.e. with practically identical illumination duration and beam intensity. This illumination duration is also referred to as "standard illumination duration". The illumination of all the pixels or of the image takes place within a predetermined image set-up time. This image set-up time is preferably a maximum of 5 ms. The standard illumination duration per pixel may then correspond in particular to the quotient of the image set-up time to the number of pixels.

Figure 4:
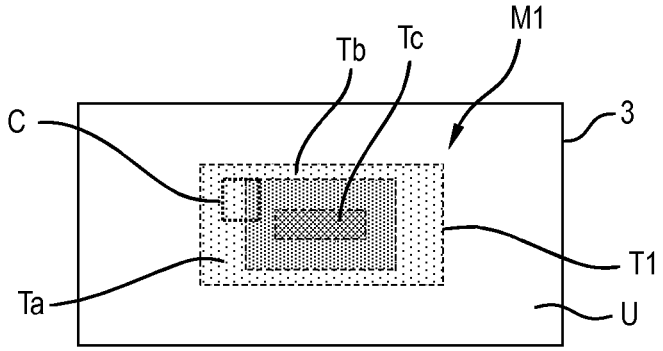
FIGS. 4 to 8 show the phosphor surface from FIG. 2 in a frontal view with a first to fifth illumination pattern.

FIG. 4 shows the phosphor surface 3 with a first illumination pattern M1 according to various embodiments. An illumination pattern may be understood to mean, for example, the pattern of the illuminated pixels on the phosphor surface 3.

Only one quarter of the entire phosphor surface 3 is illuminated in the case of this first illumination pattern M1. Therefore, within the predetermined image set-up time, the amount of time available for illuminating a pixel is on average four times greater than in the case of illumination of the phosphor surface 3 over the whole area. In this regard, the total light power can be kept constant, if desired.

For the purpose of illumination, the primary light beam P is directed only onto the actually illuminated partial surface T1 by means of the MEMS mirror 4. The MEMS mirror 4 is not directed at a partial surface U that is not to be illuminated, and so no time is lost as a result.

The targeted and illuminated partial surface T1 is arranged centrally here in the phosphor surface 3. The partial surface T1 has a non-uniform or inhomogeneous illumination duration of the pixels. In an outer partial region Ta of the partial surface T1, an illumination duration corresponds e.g. to the standard illumination duration and a light power of an individual pixel thus corresponds to the light power in the case of a uniformly illuminated phosphor surface 3. In a central partial region Tb surrounded by the outer partial region Ta, an illumination duration is greater than the standard illumination duration and a light power of an individual pixel is thus higher than in the case of a uniformly illuminated phosphor surface 3. The central partial region Tb is more brightly luminous than the outer partial region Ta within the predetermined image set-up time (e.g. 5 ms). In an inner partial region Tc surrounded by the central partial region Ta, an illumination duration and a light power of an individual pixel are the highest. The inner partial region Tc therefore is the most brightly luminous.

The higher illumination duration of a pixel may be achieved e.g. by virtue of the primary light beam P remaining on said pixel for longer than the standard illumination duration, e.g. by means of the MEMS mirror 4 being aligned with said pixel for a longer duration.

The higher illumination duration of a pixel may be achieved alternatively or additionally by the central partial region Tb and the inner partial region Tc being illuminated more intensely by multiple illumination (staggered over time) within the predetermined image set-up time. The inner partial region Tc can be irradiated even more frequently than the central partial region Tb. The multiple illumination has the advantage that the partial surface T1 is also illuminatable by means of a clocked laser 2 with a fixed switched-on duration. Moreover, saturation and possibly even damage of the phosphor can thus be prevented.

In this case, the number of partial regions is not restricted to three. A transition of the partial regions can also be implemented gradually, for example.

The first illumination pattern M1 may be used for example for generating a high beam.

Figure 5:
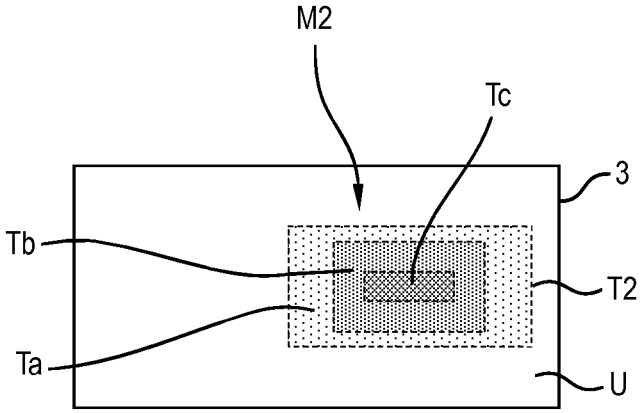

FIG. 5 shows the phosphor surface 3 with a second illumination pattern M2. The second illumination pattern M2 corresponds to the first illumination pattern M1 in its form, but is offset laterally (in the x-direction). This may have been caused for example by a lock during steering of a vehicle using the lighting device as a headlight. A possible transition from the first illumination pattern M1 to the second illumination pattern M2 can take place in the context of an AFS.

Figure 6:
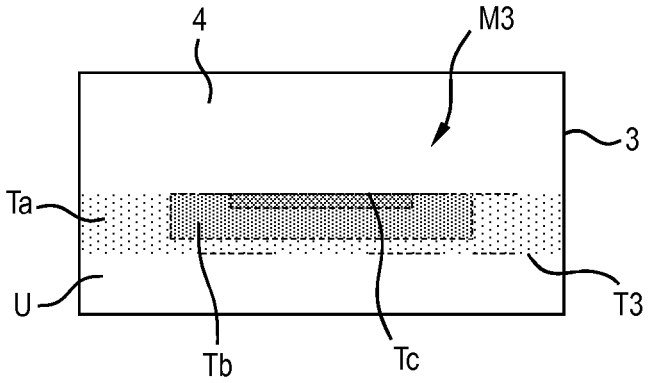

FIG. 6 shows the phosphor surface 3 with a third illumination pattern M3 with a targeted and illuminated partial surface T3. The illuminated partial surface T3 extends over the entire width (in the x-direction) of the phosphor surface 3. The size of the partial surface T3 corresponds to the size of the partial surface T1. The outer partial region Ta, the central partial region Tb and the inner partial region Tc now adjoin an upper edge of the partial surface T3. This may be advantageous for example for generating a sharp bright-dark boundary, e.g. for generating a low beam or a fog light distribution.

A total light power of the illumination pattern M3 may correspond e.g. to the total light power of the illumination patterns M1 or M2. In various embodiments, just by means of different driving of the MEMS mirror, switching between different illumination patterns, e.g. between the illumination patterns M1, M2 and/or M3, e.g. from one set-up image to the next, may thus be effected simply and in a manner practically free of delay.

Figure 7:
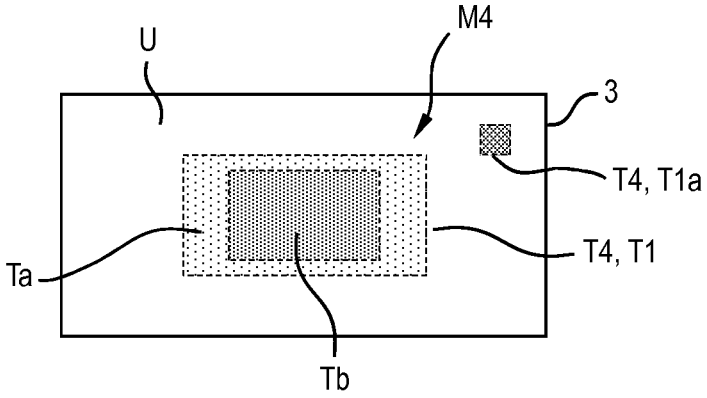

FIG. 7 shows the phosphor surface 3 with a fourth illumination pattern M4 with an illuminated partial surface T4. The partial surface T4 is composed of the partial surface T1 as in FIG. 1 and additionally a smaller ("subsidiary") partial surface T1*a* spaced apart therefrom. However, the illumination pattern of the partial surface T1 differs from that from FIG. 1 because now light power is tapped off for illuminating the subsidiary partial surface T1*a*. Therefore, the partial surface T1 does not have an inner partial region Tc, rather the central partial region Tb is extended into there. The total light power has therefore been reduced in the partial surface T1 in comparison with FIG. 1. The difference is used for illuminating the subsidiary partial surface T1*a*.

The subsidiary partial surface T1*a* may be used for example for generating a "spot" in the light emission pattern of the far field. Said spot may be generated e.g. upon recognition of an object (e.g. a pedestrian, cyclist or wild animal), in order to irradiate the object. This may be done e.g. by means of an AFS.

Figure 8:
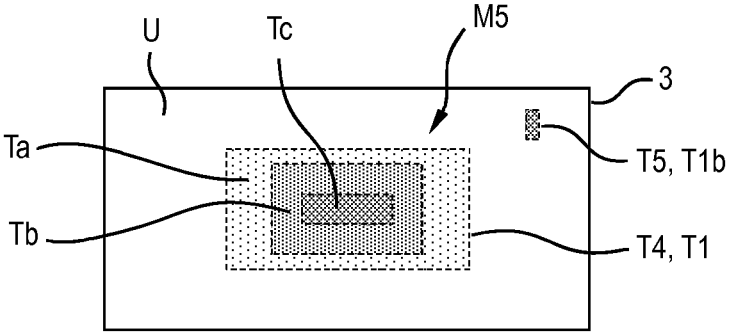

FIG. 8 shows the phosphor surface 3 with a fifth illumination pattern M5 with an illuminated partial surface T5.

The partial surface T5 is composed of the partial surface T1 as in FIG. 1 and additionally a smaller ("subsidiary") partial surface T1*b* spaced apart therefrom. The partial surface T1*b* can be used in a manner similar to the partial surface T1*a* e.g. for generating a "spot" or the like in the far field, e.g. by means of an AFS. In contrast to the illumination pattern M4, the illumination pattern of the partial surface T1 is identical to that from FIG. 1.

In order, e.g. after an object recognition, to be able to direct the spot onto the recognized objet, switching between the illumination pattern M1 and the illumination pattern M5 may be effected, for example. In order in this case not to have to change the brightness of the illumination pattern of the partial surface T1, the partial surface T1 of the illumination patterns M1 and M2 may be illuminated only with a fraction of the maximum possible total light power, e.g. with 95% or 98%. At least one additional partial surface T1*b*, etc. can then be illuminated with the difference relative to the maximum possible total light power.

Generally, in the case of the illuminated partial surfaces shown above or in the case of other illuminated partial surfaces, arbitrary regions can be cut out or no longer illuminated. In this case—in contrast e.g. to conventional HID systems—there is no need to have recourse to a few predefined cutouts. Rather, virtually all possible forms of cutouts are possible.

In one development, regions are "cut out" from an illuminated partial surface as a reaction to an object recognition, as shown e.g. by dashed lines on the basis of a position of one possible cutout C in FIG. 4. By way of example, in this regard, e.g. in the context of an AFS, regions can be cut out from a predetermined light emission pattern of a headlight in order to avoid dazzle of one or more objects (e.g. of human beings, animals, etc.). The at least one region cut out may have a width and/or height of a few centimeters, for example, in the far field (in order e.g. to omit only a head of an individual pedestrian from illumination), may have a plurality of such small regions (e.g. for a plurality of pedestrians), may have at least one relatively large region (e.g. one or more oncoming vehicles or vehicles ahead) or may even have at least one very large region (e.g. omitting many pedestrians and vehicles in town/city traffic).

In this case, in another development, the regions cut out dynamically, e.g. on account of the object recognition, do not lead to a change in the rest of the illuminated partial surface. As a result, occasionally part of the total light power available in principle may not be used within the available image set-up time. However, since a rapidly changing light emission pattern is typically present here, in practical cases this should make up only a small proportion of the duration of use of the lighting device.

In addition, it is also possible, in principle, to change the illumination pattern in such a way that the value of the total light power present beforehand (before the dynamic introduction of the cutout) is once again obtained or at least approximated. However, this may lead to irritations for a driver and in the latter's surroundings as a result of altered light distributions. By way of example, in reality a driver or an observer in the surroundings of the vehicle would likely consider it to be a relatively disturbing effect if e.g. the light in front of the vehicle repeatedly becomes sometimes brighter, sometimes darker, depending on whether and how many road users are in the region of influence of the light distribution and are intended to be masked out. By gradual and e.g. small alterations in changing the illumination pattern it is possibly nevertheless expedient, depending on the application and ambient situation, to raise the total light power. For the sake of simplicity, therefore, in practice, masking-out or non-illumination without adaptation of the total light power may rather be provided.

Figure 9:
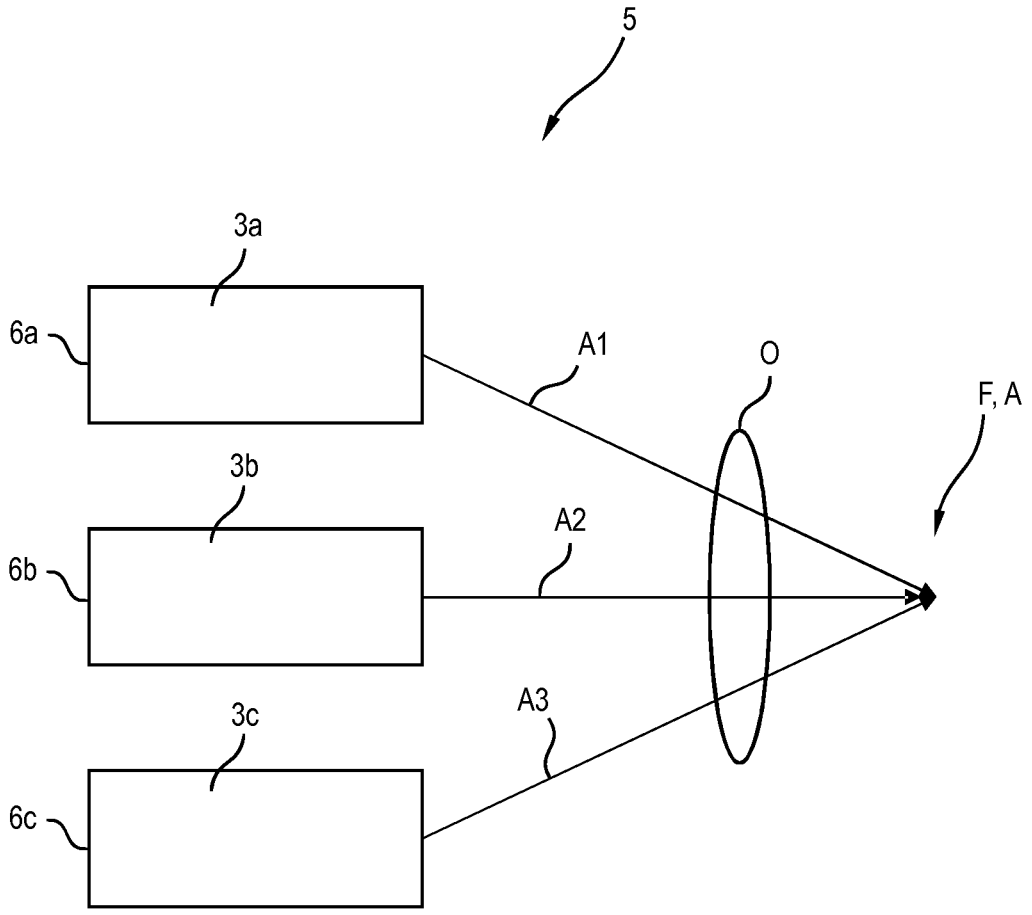
FIG. 9 shows a possible construction of a lighting device as a sectional illustration in side view.

Particularly in association with the embodiments in accordance with the above-mentioned figures, but also independently thereof, FIG. 9 shows a projection device 5 (e.g. as part of a vehicle headlight) including a plurality, here: three, of remote phosphor lighting devices 6*a*, 6*b*, 6*c*, for example in the manner of the lighting device 1. For this purpose, the remote phosphor lighting devices 6*a*, 6*b*, 6*c* may include phosphor surfaces 3*a*, 3*b* and 3*c*, respectively, having different phosphors which can be irradiated by respective primary light beams.

The remote phosphor lighting devices 6*a*, 6*b*, 6*c* emit light A1, A2, A3 of different colors into the far field F and said light is superimposed in the far field F to form a superimposed (total) light emission pattern A=A1+A2+A3, for example with the aid of a common optical unit O. The superimposed light emission pattern 3 has a purposefully inhomogeneous color distribution. This inhomogeneous color distribution may be provided, in particular, for configuring specific regions of the light emission pattern A statically or dynamically with light of a color that is functionally particularly suitable therefor. The use of independently drivable remote phosphor lighting devices 6*a*, 6*b*, 6*c* has the advantage that the mixed light of the light emission pattern A that arises in the far field F can be set and varied individually for each pixel and within a large color space. Moreover, for attaining a specific total light power or a pixel-related light power in the far field F the associated phosphor surfaces 3*a*, 3*b* and 3*c* thus need only be irradiated with a comparatively low light power. Alternatively, a higher total light power may be attained.

In one variant, the light A1, A2, A3 emitted by at least one of the remote phosphor lighting devices 6*a*, 6*b*, 6*c* into the far field F may itself correspond to mixed light, e.g. to the colors mint-green ("EQ white") and amber in the case of only two remote phosphor lighting devices and the colors cyan, magenta and yellow ("CMY") in the case of three phosphor lighting devices. The light A1, A2, A3 from the remote phosphor lighting devices that is emitted into the far field F may, however, also correspond to at least one primary color, e.g. red, green and/or blue ("RGB"). However, even further colors can also be mixed in, e.g. red or orange for a warmer hue. The mixed light composed thereof for the light emission pattern A in the far field F may be, for example, white or whitish mixed light.

However, light of all suitable colors may be generated by the remote phosphor lighting devices 6*a*, 6*b*, 6*c* and emitted into the far field F in order to generate a desired total light emission pattern there.

In one development, the primary light is converted practically completely into the respective secondary light, e.g. by the conversion of an ultraviolet primary light beam into blue, green and red primary light. The secondary light then preferably provides all colors, e.g. primary colors, necessary for color mixing. This allows a setting of a particularly large color space in the far field.

In another development, the primary light is converted only partly into the respective secondary light at least at one phosphor surface 3*a*, 3*b*, 3*c* e.g. by partial conversion of a blue primary light beam into green and red primary light. The non-converted primary light then provides a proportion of the color of the mixed light in the far field. This development has the advantage that a smaller number of remote phosphor lighting devices 6*a* and 6*b*, 6*a* and 6*c* or 6*b* and 6*c* are required (e.g. a number of the required colors minus 1).

In one development, furthermore, at least two of the phosphor surfaces 3*a*, 3*b* and/or 3*c* are irradiated by means of primary light beams of identical color (e.g. ultraviolet or blue). This simplifies a construction and e.g. also enables beam splitting when a common light source is used.

In one development, moreover, at least two of the phosphor surfaces 3*a*, 3*b* and/or 3*c* are irradiated by means of primary light beams of different colors. This enables a potential use of a large number of phosphors and a particularly efficient wavelength conversion as a result.

In one development, moreover, the mixed light emitted by at least one of the phosphor surfaces 3*a*, 3*b* and/or 3*c* or the corresponding at least one remote phosphor lighting device 6*a*, 6*b*, 6*c* is white or whitish light. A (cumulative) color locus of said mixed light may lie within the ECE white field, for example. In one specific development thereof, the mixed light emitted by at least two (especially by all) of the phosphor surfaces 3*a*, 3*b* and/or 3*c* or the corresponding at least two remote phosphor lighting devices 6*a*, 6*b*, 6*c* is white or whitish light of different spectral distributions. By way of example, the white or whitish mixed light from different remote phosphor lighting devices 6*a*, 6*b*, 6*c* may have a different color temperature and/or a different "color cast" (i.e. a perceptible admixture of a non-white color).

By the lighting devices 6*a*, 6*b*, 6*c* which are drivable independently of one another, it is also possible to achieve, for example a dynamic coloration of specific regions of the total light emission pattern in the far field F. In this regard, e.g. a frame-like region around a cutout with a signal color may be generated in order to increase a warning effect for a driver that an e.g. moving object has been recognized there.

Figure 10:
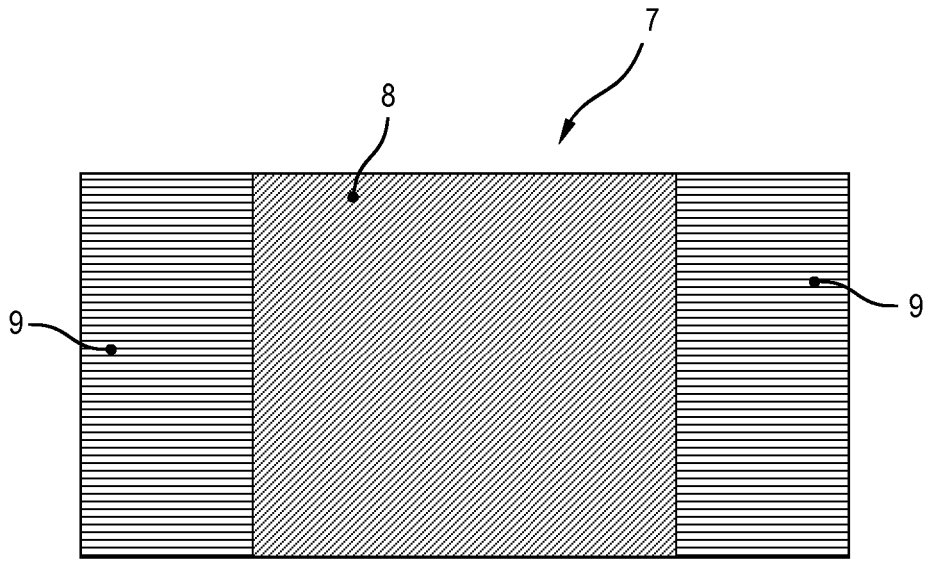
FIG. 10 shows a further phosphor surface in a frontal view.

FIG. 10 shows in a frontal view a phosphor surface 7, e.g. for use with a lighting device 1, e.g. instead of the phosphor surface 3. The phosphor surface 7 has a non-uniform or inhomogeneous distribution of a phosphor. This means, for example, that at least one region, e.g. at least one pixel, has a different concentration of the phosphor than at least one other region, e.g. at least one other pixel. By way of example, the phosphor surface 7 may be illuminated by means of a blue primary light beam P which is partly converted into yellow secondary light S by blue-yellow converting phosphor.

The phosphor surface 7 is covered here with the phosphor inhomogeneously, namely with a lower concentration in a central region 8 and with a higher concentration in a left-hand and in a right-hand outer region 9. As a result, by way of example, whitish mixed light having a slight blue cast may be emitted by the central region 8, which possibly improves visibility and/or attention. This may be advantageous e.g. when generating a light emission pattern in the far field in the form of a low beam, fog light or high beam. From the outer regions 9 there may be e.g. whitish mixed light having a slight yellow cast, e.g. in order to reduce a dazzle effect when cornering.

In various embodiments, a defined color distribution of the light emission pattern may thus be assigned to specific light emission patterns on the phosphor surface 7 using simple means.

Figure 11:
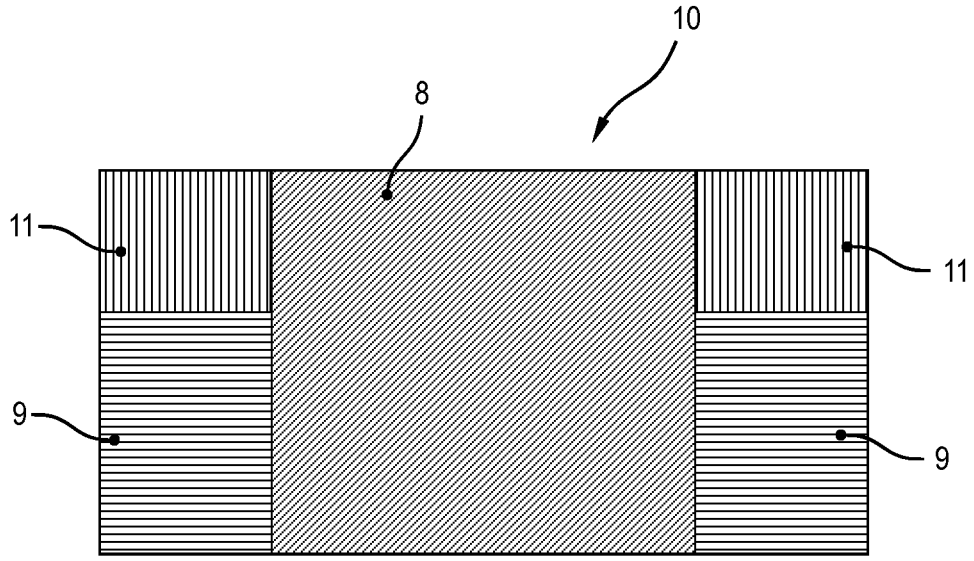
FIG. 11 shows yet another phosphor surface in a frontal view.

FIG. 11 shows in a frontal view a further phosphor surface 10, e.g. for use with the lighting device 1, e.g. instead of the phosphor surface 3. The phosphor surface 10 has a non-uniform or inhomogeneous distribution of a plurality of phosphors. This means, for example, that at least one region, in particular at least one pixel, has a different composition, e.g. concentration, of the phosphors than at least one other region, e.g. at least one other pixel.

The phosphor surface 10 is similar to the phosphor surface 7, but now the outer regions 9 do not occupy the entire height of the phosphor surface 10. Rather, now an outer part 11 of the phosphor surface 10 is additionally covered with a blue-red converting phosphor in order to generate a whitish-red region in the far field F. Said region may be e.g. a region which is typically used for generating subsidiary partial surfaces T1*a* and/or T1*b*, e.g. for generating spots on account of object recognition.

Although the invention has been described and illustrated more specifically in detail by means of the exemplary embodiments shown, nevertheless the invention is not restricted thereto and other variations can be derived therefrom by the person skilled in the art, without departing from the scope of protection of the invention.

Generally, "a (an)", "one" etc. can be understood to mean a singular or a plural, in particular in the sense of "at least one" or "one or a plurality", etc., as long as this is not explicitly excluded, e.g. by the expression "exactly one", etc.

Moreover, a numerical indication can encompass exactly the indicated number and also a customary tolerance range, as long as this is not explicitly excluded.

REFERENCE SIGNS

1 lighting device
2 laser
3 phosphor surface
4 MEMS mirror
5 projection device
6*a*-6*c* remote phosphor lighting device
7 phosphor surface
8 central region
9 outer region
10 phosphor surface
11 outer part
A light emission pattern
A1-A3 light
C cutout from an illuminated partial surface
D rotation axis
F far field
L lens
M illumination pattern
M1 first illumination pattern
M2 second illumination pattern
M3 third illumination pattern
M4 fourth illumination pattern
M5 fifth illumination pattern
O optical unit
P primary light beam
Q primary optical unit
S secondary light
T1 illuminated partial surface of the phosphor surface
T1*a* subsidiary partial surface
T1*b* subsidiary partial surface
T3-T5 partial surfaces
Ta outer partial region
Tb central partial region
Tc inner partial region
U non-illuminated partial surface of the phosphor surface
x x-direction (line direction)
y y-direction (column direction)

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for generating a light emission pattern by illuminating at least one phosphor surface by at least one primary light beam, the method comprising:

directing the primary light beam in a scanning fashion only onto a partial surface of the entire illuminatable phosphor surface; and illuminating at least one partial region of said partial surface more intensely than in the case of uniform illumination of the illuminatable phosphor surface, wherein an illumination duration of at least one focal spot in the partial surface within an image set-up time is greater than a standard illumination duration for uniform illumination of the entire illuminatable phosphor surface;

wherein the standard illumination duration is a time duration which a pixel is illuminated or generated in the case of uniform illumination of the entire illuminatable phosphor surface, and wherein the image set-up time is a time duration which is required in order to uniformly illuminate the entire illuminatable phosphor surface.

2. The method of claim 1, wherein the phosphor surface is illuminatable in a pixel-like fashion and a portion of the pixels is illuminated for longer integrally within the image set-up time than during the uniform illumination of the phosphor surface.

3. The method of claim 1, wherein switching between two different illumination patterns of the phosphor surface with similar total light power is effected.

4. The method of claim 3, wherein switching between two different illumination patterns of the phosphor surface with identical total light power is effected.

5. The method of claim 1, wherein the more intensely illuminated partial region of the partial surface is illuminated more intensely by the primary light beam remaining for longer than in the case of the uniform illumination of the entire illuminatable phosphor surface.

6. The method of claim 1, wherein the more intensely illuminated partial region of the partial surface is illuminated more intensely by multiple illumination within the predetermined image set-up time.

7. The method of claim 1, wherein the method serves for generating at least one light emission pattern of a vehicle.

8. The method of claim 1, wherein the image set-up time lasts a maximum of 5 milliseconds.

9. The method of claim 1, wherein at least one region from an illuminated partial surface is no longer illuminated on account of an object recognition.

10. The lighting device of claim 1, wherein an average illumination duration of the partial surface is inversely proportional to an area portion of the entire illuminatable phosphor surface that is constituted by the partial surface.

11. A lighting device for generating a light emission pattern within a predetermined image set-up time, the lighting device comprising:

at least one light source configured to generate at least one primary light beam; and a deflection unit configured to direct the primary light beam generated by the at least one light source onto a phosphor surface in a scanning fashion;

wherein the phosphor surface is designed, at a focal spot of a primary light beam, at least partly to convert the associated primary light into secondary light having a different wavelength;

wherein the lighting device is designed to direct the primary light beam only onto a partial surface of the entire illuminatable phosphor surface, and an illumination duration of at least one focal spot in the partial surface within an image set-up time is greater than a standard illumination duration for the uniform illumination of the phosphor surface;

wherein the standard illumination duration is a time duration which a pixel is illuminated or generated in the case of uniform illumination of the entire illuminatable phosphor surface, and wherein the image set-up time is a time duration which is required in order to uniformly illuminate the entire illuminatable phosphor surface.

12. The lighting device of claim 11, wherein the deflection unit is a deflection unit which deflects in a scanning fashion in at least one spatial direction.

13. The lighting device of claim 11, wherein the deflection unit is a deflection unit which deflects individually in two spatial directions.

14. The lighting device of claim 11, wherein the at least one switched-on light source has a constant beam power and is operable in a clocked fashion.

15. The lighting device of claim 11, wherein the lighting device is a vehicle lighting device.

16. The lighting device of claim 15, wherein the vehicle lighting device is a headlight.

17. The lighting device of claim 16, wherein the headlight is an Adaptive Frontlighting System headlight.

* * * * *